United States Patent [19]

Logsdon

[11] 4,158,471

[45] Jun. 19, 1979

[54] WASHING MACHINE OUTLET BOX

[75] Inventor: Duane D. Logsdon, Fullerton, Calif.

[73] Assignee: The Logsdon Foundation, Stanton, Calif.

[21] Appl. No.: 890,525

[22] Filed: Mar. 27, 1978

[51] Int. Cl.[2] ..... A47B 77/06; F16L 5/00

[52] U.S. Cl. ..... 312/229; 312/228; 312/242; 137/360

[58] Field of Search ..... 312/229, 228, 242, 351; 285/3 R, 4 R, 137 R; 137/360; 220/3.92; 248/27.3

[56] References Cited

U.S. PATENT DOCUMENTS

| | | | |
|---|---|---|---|
| 1,963,951 | 6/1934 | Bowers | 220/3.92 |
| 3,096,782 | 7/1963 | Williams | 220/4 R |
| 3,131,952 | 5/1964 | D'Esopo | 285/3 R |
| 3,148,698 | 9/1964 | Arnold | 137/360 |
| 3,654,965 | 4/1972 | Gramain | 285/137 R |
| 3,731,952 | 5/1973 | Elwart | 285/3 |
| 3,831,624 | 8/1974 | Doumany | 137/360 |
| 3,834,781 | 9/1974 | Logsdon | 312/229 |
| 3,847,175 | 11/1974 | Anderson | 137/360 |
| 3,862,433 | 1/1975 | Rousselet | 137/360 |
| 3,866,950 | 2/1975 | Skoch et al. | 285/4 R |

*Primary Examiner*—Victor N. Sakran
*Attorney, Agent, or Firm*—Edward D. O'Brian

[57] ABSTRACT

A washing machine outlet box of the type having a water impervious plastic cabinet and a bottom sloping to a drain outlet can be improved by providing the washing machine outlet box with a detachable drain pipe, adjustable mounting brackets and variable size knockout plugs. The detachable drain pipe is secured to the cabinet by matching screw threads on both the drain pipe and the cabinet. The adjustable brackets allow the washing machine outlet box to be mounted in a wall in a variety of positions, while the variable size knockout plugs can accommodate hot and cold water inlets of either copper tubing or galvanized pipe in such a manner as to form a water-tight seal with either type pipe.

13 Claims, 8 Drawing Figures

WASHING MACHINE OUTLET BOX

BACKGROUND OF THE INVENTION

This invention relates to improvements in a washing machine outlet box and more particularly to a washing machine outlet box capable of being mounted to a wall in a variety of positions and also capable of adapting to several sizes of water inlet pipes and drain pipes.

Washing machine outlet boxes provide for neat, orderly and aesthetically pleasing methods of attaching the inlet hoses and the drain hose of a washing machine to the hot and cold water inlet pipes and to the sewer drain pipe. However, in addition to these functions, even more importantly, they also serve as a container to catch and dispose of any leakage water from the connections and taps between the hoses of the washing machine and the hot and cold water inlet pipes. Should any of these connections or taps leak, the leakage water can cause damage to both the adjacent wall surface and also the floor underneath the leaky connection or tap.

In my prior U.S. Pat. No. 3,834,781, issued Sept. 10, 1974, the disclosure of which is herein incorporated by reference, I described a washing machine outlet box of the type having a water impervious plastic cabinet capable of being mounted within a wall between support members, i.e., wall studs. This washing machine outlet box had fixed tab-like brackets on its sides for mounting to the support members. Because these tabs were fixed, the washing machine outlet box was only capable of being mounted in one position relative to the surface of the wall. Depending upon the thickness of the material used for the wall surface, e.g., panels approximately ⅛ inch thick or plasterboard approximately ½ inch thick, the front opening of the washing machine outlet box may or may not fit flush with the surface of a wall. If said front opening did not fit flush it is considered that this is particularly disadvantageous in installations such as that of a washing machine in a kitchen where the finished appearance of the washing machine outlet box is important.

Further, my prior washing machine outlet box could only accommodate one size of pipe for the hot and cold water inlets. Commonly used as hot and cold water inlets are ½ inch copper and ½ inch galvanized pipe. Both of these have a ½ inch internal diameter; however, the external diameters of these pipes are different—that of the galvanized being larger than that of the copper. Because both copper and galvanized pipes are commonly in use for plumbing in structures wherein washing machine outlet boxes are used, it is considered disadvantageous to only have one size pipe inlet hole in the body of the washing machine outlet box. If only one hole is present it will, of necessity, have to be large enough to accommodate the outer dimensions of the galvanized pipe. Thus, if copper pipe is used there will be a space between the outside of the copper pipe and the surface of the hole through which the pipe traverses. This space must be sealed with a gasket or sealing compound in order to form a water tight seal between the pipe and the washing machine outlet box.

Because the washing machine outlet box of my prior patent had both fixed tab-like brackets and a fixed drain pipe extending from the surface of the cabinet, it was required that said washing machine outlet boxes be packaged and stored in large containers. Because of the additional costs involved in preparing larger boxes and the additional space required to store these larger boxes it is considered advantageous to provide a washing machine outlet box having brackets and drain pipes which can be stored within the interior of the washing machine outlet box during shipping but can be mounted on the outside surface of the washing machine outlet box when this box is installed.

SUMMARY OF THE INVENTION

From the foregoing paragraph it is believed that there is still a need for new and improved washing machine outlet boxes. It is therefore a broad object of this invention to fulfill this need. Further, it is an additional object to fulfill this need yet provide a washing machine outlet box which is easily and economically manufactured, yet is durable and will provide for many years of service.

In accordance with the present invention these and other objects are provided for by a washing machine outlet box of the type having a water impervious plastic cabinet which has a funnel-shaped bottom terminating in a drain opening. The washing machine outlet box is improved by providing the cabinet with a detachably mounted drain pipe and means on the drain pipe and the cabinet for forming a water tight coupling between the drain pipe and the cabinet. Further the washing machine outlet box is provided with detachable brackets for attaching the cabinet to the supporting members in a wall. Moreover, the washing machine outlet box is fitted with compound knockout plugs which provide for variable sized inlet pipe openings.

BRIEF DESCRIPTION OF THE DRAWING

The washing machine outlet box of the invention will be best explained and understood in view of the remainder of this specification, the appended claims and the accompanying drawing in which:

Figure 1:
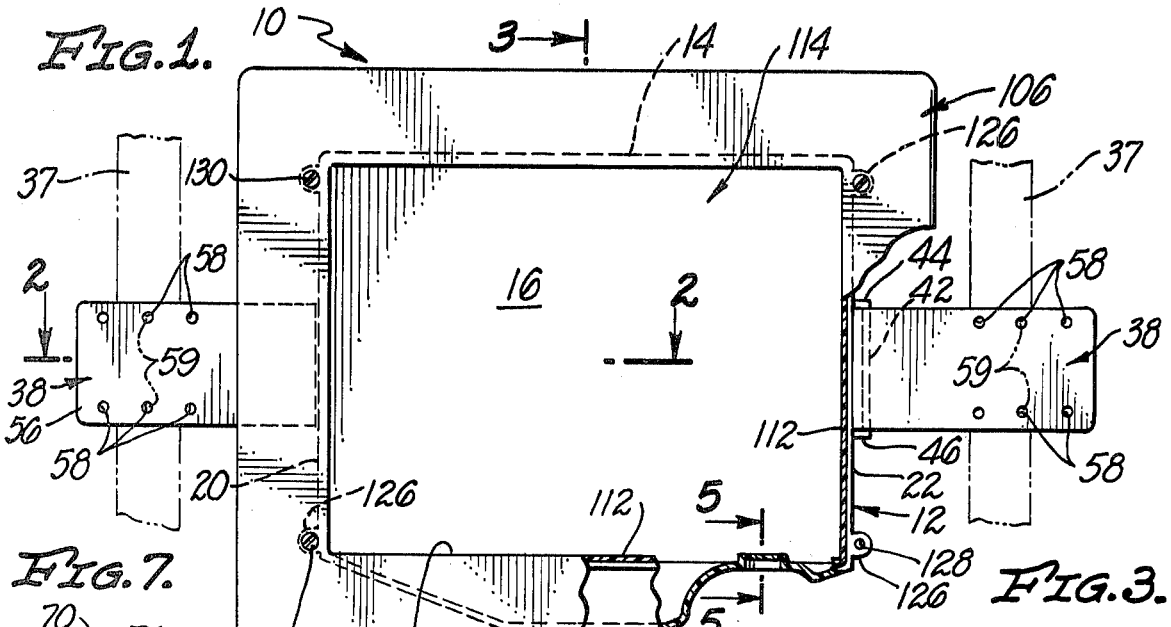
FIG. 1 is an elevational view in partial cross section of the preferred embodiment of a washing machine outlet box.

The washing machine outlet box illustrated in the drawing is constructed so as to utilize the essentially intangible concepts of the invention set forth and defined by the appended claims. It will be realized that these concepts can be utilized within a variety of somewhat differently appearing and differently constructed structures through the use of routine engineering or design skill.

DETAILED DESCRIPTION

A washing machine outlet box 10 is constructed of an impervious plastic cabinet 12. This cabinet 12 has a top 14, a back 16, bottom 18, and sides 20 and 22, all of which are integrally formed from one piece of plastic using common molding techniques. Bottom 18 generally slopes down in a funnel-like shape to bottom drain opening 24. A pipe 26 is attached to bottom 18 at bottom drain opening 24 and forms a conduct from the washing machine outlet box 10 to a common drain (not shown). Pipe 26 is attached to bottom 18 by internal screw threads 28 around the interior of bottom drain opening 24 which mate with external screw threads 30 around the top of pipe 26. A water tight seal is formed between pipe 26 and bottom 18 when pipe 26 is screwed onto bottom 18.

Midway down pipe 26 is a shoulder 32 which divides pipe 26 into an upper section 34 and a lower section 36. Upper section 34 has a larger internal diameter than lower section 36. When pipe 26 is fitted to a drain pipe of a small diameter lower section 36 is utilized to connect the washing machine outlet box 10 to the drain pipe. If, however, the drain pipe is of a larger diameter lower section 36 can be removed from pipe 26 by sawing through pipe 26 slightly above shoulder 32. Generally pipe section 36 will be 1½ inches in diameter and pipe section 34 will be two inches in diameter.

The washing machine outlet box 10 is placed in a wall between two wall studs 37, shown in phantom lines. The washing machine outlet box 10 is attached to these wall studs via two brackets both identified by numeral 38. The brackets 38 are in turn attached to two identical flat sleeves both identified by numeral 40 which are integrally formed on the sides 20 and 22 of cabinet 12. Sleeves 40 have an outside wall 42 attached to a top wall 44 and a bottom wall 46. An inside wall 48, which is in part synonomous with side walls 20 or 22, traverses through the interior of sleeves 40. The part of inside wall 48 which is synonomous with side walls 20 or 22 occurs at the front opening 50 of sleeves 40. Within the interior of sleeves 40 inside wall 48 rises obliquely from the outside surface 49 of side walls 20 and 22 and at rear opening 52 it forms a ledge or lip 54 above the outside surface 49 of side walls 20 and 22. With respect to the outside surface 49 of sides 20 and 22 inside wall 48 is of a wedge shape. The front point of this wedge meeting the surface 49 of sides 20 and 22 at the front opening 50 of sleeve 40. At the rear opening 52 of sleeve 40, the thick portion of the wedge rises above surface 49 of sides 20 and 22 forming lip 54. Top wall 44 and bottom wall 46 are perpendicular to both the sides 20 or 22 and to outside wall 42. Top wall 44, bottom wall 46, outside wall 42, and inside wall 48 all are integrally formed with cabinet 12.

Figure 7:
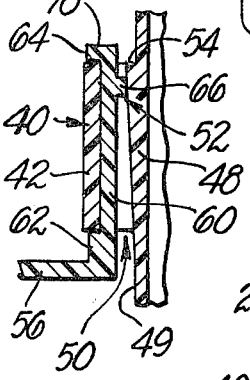
FIG. 7 is a partial cross-sectional view of a first position of the mounting components of the washing machine outlet box shown in FIG. 2.
Figure 2:
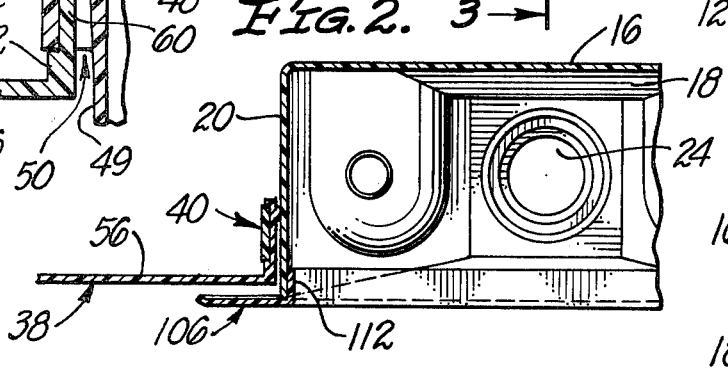
FIG. 2 is a partial cross-sectional view taken at line 2—2 of FIG. 1 showing the interior of the bottom of the washing machine outlet box.
Figure 3:
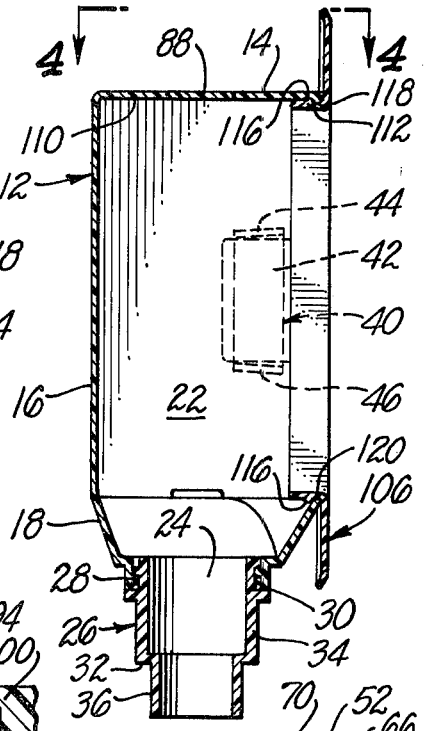
FIG. 3 is a side cross-sectional view at the line 3—3 of FIG. 1 of the washing machine outlet box.
Figure 4:
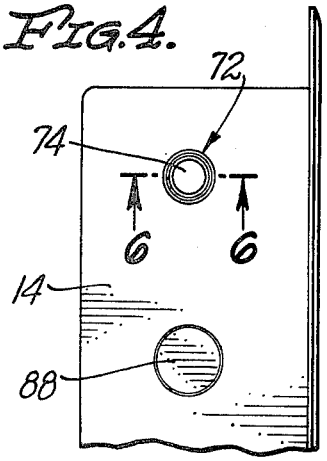
FIG. 4 is a plan view of a portion of the top of the washing machine outlet box taken at line 4—4 of FIG. 3.
Figure 5:
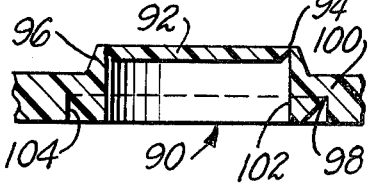
FIG. 5 is a partial cross-sectional view taken at line 5—5 of a compound knockout plug in the bottom of the washing machine outlet box.
Figure 6:
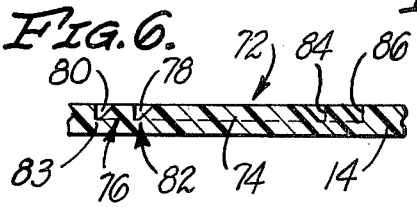
FIG. 6 is a partial cross-sectional view taken at line 6—6 of FIG. 4 of a compound knockout plug in the top of the washing machine outlet box.
Figure 8:
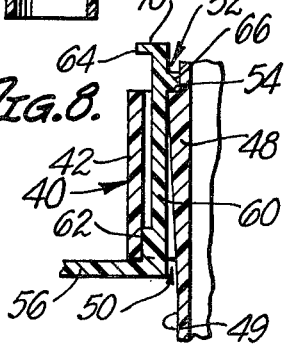
FIG. 8 is a cross-sectional view of a second position of the mounting components of the washing machine outlet box shown in FIG. 2.

Brackets 38 when viewed sideways have essentially an "L" shape. The front portion or tab 56 of bracket 38 extends perpendicular from sides 20 and 22 and contains a series of holes collectively identified by numeral 58 by which bracket 38 is fixed to a wall stud 37 by nails or screws collectively identified by numeral 59. A rear portion or tab 60 of bracket 38 is inserted into elongated flat sleeves 40 and is held in the sleeve 40 in one of two interchangeable positions. These positions are achieved by the interaction of ribs 62, 64 and 66 integrally formed on rear tab 60 and the front opening 50 and rear opening 52 of elongated sleeve 40. Ribs 62 extend along the inside edge 68 where front tab 56 joins rear tab 60. Ribs 64 extend along the back edge 70 of rear tab 60 on the same side of and parallel to rib 62. Rib 66 extends along rear tab 60 on the opposite side of and parallel to rib 62. Rib 66 is displaced from the end of rear tab 60 such that the distance between rib 66 and front tab 56 is the same as the width of outside wall 42 of elongated flat sleeve 40. This allows bracket 38 to be held in two fixed positions in respect to sleeve 40. In the first position shown in FIG. 7 the front opening 50 of sleeve 40 abuts against rib 62 and the rear opening 52 of sleeve 40 abuts against rib 64. In this position rib 66 pushes against inside wall 48 and this forces rear tab 60 to push against outside wall 42 causing this wall to distort slightly holding bracket 38 in position. Because sleeve 40 is formed of a plastic material outside wall 42 can flex slightly allowing wall 42 to be reversibly distorted by the action of rib 66. Bracket 38 can be pushed into a second position as shown in FIG. 8. As rear tab 60 of bracket 38 is pushed through sleeves 40 from said first position toward said second position rib 66 slides against inside wall 48. When rib 66 is completely through sleeve 40, rib 66 pops into position against lip 54. At the same time rib 62 is pushed into the front opening 50 of sleeve 40 and distorts sleeve 40 slightly. Bracket 38 fits against front opening 50 of sleeve 40 and together with rib 66 abutting against lip 54 bracket 38 is held in the second position.

The washing machine outlet box 10 is provided with a series of knockout plugs in both its top 14 and bottom 18. These plugs are integrally formed with the plastic cabinet 12 when the cabinet 12 is molded and provide for a watertight seal until the plugs are removed. These plugs are of two types. Two plugs in top 14 both identified by numeral 72 are a double knockout plug which lie flush with the surface of the top 14. The upper plugs 72 have a central disk 74 which is separated by a ring 76 by a score groove 78. Ring 76 is in turn separated from the body of top 14 by a score groove 80. The score grooves 78 and 80 are formed in the plastic approximately halfway through the thickness of the plastic. The remaining plastic material joining disk 74 to ring 76 and ring 76 to the body of top 14 forms thin breakable membranes 82 and 83. Disk 74 is removed from the body of top 14 by striking disk 74 with a hammer or other instrument breaking membrane 82 and separating disk 74 from ring 76. A hole 84 is thus formed in the top 14. The diameter of hole 84 is usually chosen such that a common ½ inch copper pipe (not shown) will fit through hole 84 with a minimum of clearance between the pipe and top 14. If ring 76 is removed from the top 14 by breaking membrane 83 separating ring 76 from the body of top 14, a hole 86 having a larger diameter than hole 84 is formed. The size of hole 86 is chosen such that it will accommodate a common ½ inch galvanized pipe (not shown). Additionally, in the center of top 14 a single knockout plug 88 similar to the compound knockout plug 72 is provided for attaching a condensate line (not shown) to washing machine outlet box 10.

Bottom 18 is provided with two compound knockout plugs, both identified by numeral 90, similar to upper plug 72 except that knockout plugs 90 have a central disk 92 which is joined by a breakable membrane 94 to a collar 96. Collar 96 is separated from bottom 18 by a score line 98 in bottom 18. The remaining plastic material in bottom 18 adjacent to score line 98 forms a breakable membrane 100. If disk 92 is removed from bottom 18 by striking with a hammer or other similar tool a hole 102 is formed in collar 96. The diameter of hole 102 is chosen such that a common ½ inch copper pipe (not shown) will fit snugly within collar 96 and form a seal between collar 96 and the pipe. Because of the shape of collar 96 a grommet is not needed around the copper pipe to form a seal between the pipe and bottom 18. Collar 96 can be removed by breaking membrane 100 forming a hole 104 having a diameter chosen such that it will accommodate a common ½ inch pipe (not shown) in the same manner as hole 86 in top 14. Face plate 106 is attached to the front of plastic cabinet 12 to give the final installation a finished appearance. Face plate 106 is a flat plate 108 having a rectangular hole 110 through its front surface. Extending around rectangular hole 110 is a continuous flange 112. The dimensions of hole 110 are chosen such that flange 112 will fit into the interior of front opening 114 of cabinet 12. Face plate 106 is attached to cabinet 12 by providing flange 112 with a series of parallel ribs 116 near its four corners (not separately numbered). Ribs 116 interact and lock with ribs 118 on the underside of top 14 and with the upper edge 120 of bottom 18. Additionally face plate 106 is provided with four indent holes 122 on its rear surface (not separately numbered). By striking the indent with a pointed object a hole is formed in cover 106. Cabinet 12 has four ears collectively identified by numeral 126 near its four corners. Ears 126 are each provided with a hole 128. Ears 126 are so placed on cabinet 12 that the holes 128 in ears 126 line up with the holes in face plate 106 and face plate 106 can be secured to cabinet 12 with four screws 130. Because the washing machine outlet box 10 is provided with knockout holes in both the bottom 18 and top 14 it can conveniently be used in installation wherein the hot and cold inlet water pipes extend either down from the ceiling or up through the floor.

I claim:

1. A washing machine outlet box capable of fitting within a wall and attaching to support members in that wall of the type having an integrally formed, water impervious plastic cabinet wherein said cabinet has a top, a back, sides, a front opening and a bottom, said bottom having a generally funnel-like shape terminating in a bottom drain opening, the improvement which comprises:

detachably mounted drain means;

said detachably mounted drain means including a first coupling means on said bottom of said plastic cabinet and a pipe-like extension having a second coupling means on one end thereof;

said first coupling means interlocking with said second coupling means to form a water-tight seal between said bottom of said plastic cabinet and said pipe-like extension;

variable position attaching means for attaching said outlet box to said support member;

said variable position attaching means comprising two holding means for fastening bracket means thereto, one of said holding means on one side of said impervious plastic cabinet the other of said holding means on the other side of said impervious plastic cabinet and two bracket means which interlock with said holding means and are capable of being attached to said support members such that said cabinet is capable of fitting within said wall in at least two positions in respect to the distance from said cabinet to the surface of said wall;

multiple size pipe ingress means in said impervious plastic cabinet.

2. The washing machine outlet box of claim 1 wherein:

said first coupling means on the bottom of said plastic cabinet comprises an internal screw thread in the bottom drain opening of said bottom of said cabinet and said second coupling means comprises an external screw thread on one end of said pipe-like extension such that said pipe-like extension threads into and seals against the bottom drain opening in said bottom of said cabinet.

3. The washing machine outlet box of claim 1 wherein:

said holding means comprises two identical elongated flat sleeves, one elongated flat sleeve integrally formed on one of the sides of said cabinet and the other elongated flat sleeve integrally formed on the other side of said cabinet; and said bracket means comprises two identical brackets, each having a first portion thereof which fits into said elongated flat sleeves, and each having a second portion which is capable of attaching to said support means.

4. The washing machine outlet box of claim 1 wherein:

said multiple size pipe ingress means comprises a plurality of compound knockout plugs integrally formed with said impervious plastic cabinet.

5. The washing machine outlet box of claim 4 wherein:

said multiple size pipe ingress means comprises two compound knockout plugs integrally formed in the top of said impervious plastic cabinet and two compound knockout plugs integrally formed in the bottom of said impervious plastic cabinet.

6. The washing machine outlet box of claim 5 wherein:

said compound knockout plugs comprise a central disk; a circular body surrounding this disk; said central disk being integrally attached to the inside perimeter of said circular body by a first breakable membrane and said circular body being integrally attached to said bottom or said top of said plastic cabinet by a second breakable membrane between said cabinet and the outside perimeter of said circular body, such that said disk can be removed from said cabinet by breaking said first membrane between said disk and said circular body forming an opening of one size and said circular body can be removed from said cabinet by breaking said second membrane between said circular body and said cabinet forming an opening of a second size.

7. The washing machine outlet box of claim 6 wherein:

in said compound knockout plug in said bottom of said cabinet, said circular body comprises an upstanding collar, said collar having an uppermost end and a lowermost end, said disk attaching to said uppermost end of said collar by said first breakable membrane and the lowermost end of said collar attaching to said bottom of said cabinet by said second breakable membrane.

8. A washing machine outlet box capable of fitting within a wall and attaching to support members in that wall of the type having an integrally formed, water impervious plastic cabinet wherein said cabinet has a top, a back, sides, a front opening and a bottom, said bottom having a generally funnel-like shape terminating in a bottom drain opening, the improvement which comprises:

detachably mounted drain means;

said detachably mounted drain means including a first coupling means on said bottom of said plastic cabinet and a pipe-like extension having a second coupling means on one end thereof;

said first coupling means interlocking with said second coupling means to form a water-tight seal between said bottom of said plastic cabinet and said pipe-like extension;

variable position attaching means for attaching said outlet box to said support member;

said variable position attaching means comprising a holding means on said impervious plastic cabinet and a bracket means which interlocks with said holding means and is capable of being attached to said support members;

multiple size pipe ingress means in said impervious plastic cabinet;

said elongated flat sleeve comprises a flat outside wall, a top wall and a bottom wall perpendicular and integrally formed with said outside wall and an inside wall;

said elongated flat sleeve having a front opening and a rear opening;

said inside wall of said elongated sleeve extending flush from said side of said cabinet at said front opening, obliquely through said elongated flat sleeve to said rear opening and at said rear opening said inside wall projects above said side of said cabinet forming a lip;

said bracket means comprises a first flat plate and a second flat plate integrally formed and attached at right angles to each other;

said first flat plate and said second flat plate each having two flat surfaces;

said first flat plate having at least one hole through its flat surfaces whereby said bracket means is attached to said support member by a nail or screw passing through said hole;

said second flat plate having a plurality of ribs on its flat surfaces, the longitudinal axis of said ribs being parallel to the line where said first plate joins said second plate;

such that when said second flat plate is pushed into said elongated flat sleeve, said bracket is reversibly held in said elongated flat sleeve in at least two positions by said ribs interacting with said front and rear opening of said elongated flat sleeve.

9. The washing machine outlet box of claim 8 wherein:

said second flat plate has three ribs on its surface;

a first rib on that surface of said second flat plate which is at a right angle to said first plate; said first rib lying on the line wherein said first and said second plate join;

a second rib lying on the same surface as the first rib, said second rib parallel to said first rib;

a third rib parallel to said first and said second ribs but lying on the other surface of said second plate;

such that said bracket is held in said sleeve in said first position by said first rib abutting against said front opening of said sleeve and said second rib abutting against said rear opening of said sleeve, and said bracket is held in said second position by said third rib abutting against said lip at said rear opening of said sleeve and said first plate abutting against said front opening of said sleeve.

10. The washing machine outlet box of claim 2 wherein:

said pipe-like extension includes a shoulder interposed between the two ends of the pipe-like extension, said shoulder dividing the pipe-like extension in two parts having different diameters.

11. The washing machine outlet box of claim 1 including:

face plate means, said face plate means fitting over the front opening of said plastic cabinet, said face plate means having a cutout portion providing access through said face plate means into said plastic cabinet, fastening means for attaching said face plate means to said plastic cabinet.

12. A washing machine outlet box, capable of fitting within a wall and attaching to support members in that wall of the type having an integrally formed water impervious plastic cabinet wherein said cabinet has a top, a back, sides, a front opening and a bottom, said bottom having a generally funnel-like shape terminating in a bottom drain opening, the improvement which comprises:

detachably mounted drain means, said detachably mounted drain means including a first coupling means on said bottom of said plastic cabinet and a pipe-like extension having a second coupling means on one end thereof, said first coupling means on the bottom of said plastic cabinet comprises an internal screw thread in the bottom drain opening of said bottom of said cabinet and said second coupling means comprises an external screw thread on one end of said pipe-like extension such that said pipe-like extension threads into and seals against the bottom drain opening in said bottom of said cabinet;

variable position attaching means for attaching said outlet box to said support member, said variable position attaching means comprising a holding means on said impervious plastic cabinet and a bracket means which interlocks with said holding means and is capable of being attached to said support members, said holding means comprises two identical elongated flat sleeves, one elongated flat sleeve integrally formed on one of the sides of said cabinet and the other elongated flat sleeve integrally formed on the other side of said cabinet, said elongated flat sleeve comprises a flat outside wall, a top wall and a bottom wall perpendicular and integrally formed with said outside wall, an inside wall, said elongated flat sleeve having a front opening and a rear opening, said inside wall of said elongated sleeve extending flush from said side of said cabinet at said front opening, obliquely through said elongated flat sleeve to said rear opening and at said rear opening said inside wall projects above said side of said cabinet forming a lip, said bracket means comprises a first flat plate and a second flat plate integrally formed and attached at right angles to each other, said first flat plate and said second flat plate each having two flat surfaces, said first flat plate having at least one hole through its flat surfaces whereby said bracket means is attached to said support member by a nail or screw passing through said hole, said second flat plate having a plurality of ribs on its flat surfaces, the longitudinal axis of said ribs being parallel to the line where said first plate joins said second plate, such that when said second flat plate is pushed into said elongated flat sleeve, said bracket is reversibly held in said elongated flat sleeve in at least two positions by said ribs interacting with said front and rear opening of said elongated flat sleeve;

multiple size pipe ingress means in said impervious plastic cabinet, said multiple size pipe ingress means comprises two compound knockout plugs integrally formed in the top of said impervious plastic cabinet and two compound knockout plugs integrally formed in the bottom of said impervious plastic cabinet, said compound knockout plugs comprise a central disk, a circular body surrounding this disk, said central disk being integrally attached to the inside perimeter of said circular body by a first breakable membrane and said circular body being integrally attached to said bottom or said top of said plastic cabinet by a second breakable membrane between said cabinet and the outside perimeter of said circular body, such that said disk can be removed from said cabinet by breaking said first membrane between said disk and said circular body forming an opening of one size and said circular body can be removed from said cabinet by breaking said second membrane between said circular body and said cabinet forming an opening of a second size.

13. The washing machine outlet box of claim 12 including:

face plate means, said face plate means fitting over the front opening of said plastic cabinet, said face plate means having a cutout portion providing access through said face plate means into said plastic cabinet, fastening means for attaching said face plate means to said plastic cabinet.

* * * * *